United States Patent [19]

Haloila

[11] Patent Number: 4,936,080

[45] Date of Patent: Jun. 26, 1990

[54] DEVICE AND METHOD FOR SPREADING OF A TOP WRAPPING FILM

[75] Inventor: Matti Haloila, Poikko, Finland

[73] Assignee: Oy M. Haloila AB, Finland

[21] Appl. No.: 333,334

[22] Filed: Apr. 5, 1989

[30] Foreign Application Priority Data

Apr. 6, 1988 [FI] Finland ..... 881601

[51] Int. Cl.[5] ..... B65B 13/04

[52] U.S. Cl. ..... 53/465; 53/176; 53/218

[58] Field of Search ..... 53/465, 461, 218, 210, 53/203, 389, 176, 556, 587, 588

[56] References Cited

U.S. PATENT DOCUMENTS

| | | | |
|---|---|---|---|
| 3,640,048 | 2/1972 | Zelnick et al. | 53/465 X |
| 3,893,279 | 7/1975 | Bostrom | 53/176 X |
| 4,450,668 | 5/1984 | Grossi | 53/176 |
| 4,587,796 | 5/1986 | Haloila | 53/176 X |

*Primary Examiner*—James F. Coan
*Attorney, Agent, or Firm*—Steinberg & Raskin

[57] ABSTRACT

A device for spreading of a top wrapping flm in wrapping in a wrapping machine. The wrapping machine is provided with a top film device which has a top film roll as well as devices for feeding and pulling the top film. These devices are arranged to spread the top film above the product to be packaged and to cut the top film to the specified dimension. The device is provided, as well, with a press plate which presses the product to be packaged from above, for the purpose of keeping the product to be packaged in position during the wrapping. The devices for feeding and for pulling of the top film are arranged on a frame of the wrapping machine, to be simultaneously movable in opposite directions with respect to one another. When products to be packaged are being exchanged and when the wrapping is interrupted, the feed device is arranged to pull a top film out of a top film roll substantially to a middle of the wrapping station. The pulling device is arranged to fetch or grasp a leading end of the top film from a middle of the wrapping station and to pull the top film across the wrapping station underneath the press plate, and to a stand-by position. At the same time, the feed device returns to its starting position and cuts off the top film to a specified dimension. A method for the spreading of the top wrapping film is also provided herein.

17 Claims, 4 Drawing Sheets

DEVICE AND METHOD FOR SPREADING OF A TOP WRAPPING FILM

BACKGROUND OF THE INVENTION

The present invention concerns a device for spreading of a top wrapping film during wrapping in a wrapping machine. This wrapping machine is provided with a film distribution sledge, and a film roll being fitted on the sledge, from which wrapping film is arranged to be wound around a product to be packaged in the wrapping machine, this product having been brought into a wrapping station by means of a conveyor or equivalent. The product is wrapped by rotating the film distribution sledge around a vertical central axis of the wrapping station.

More specifically, a top film device is provided which comprises a top-film roll as well as devices for feeding and pulling the top film. These devices are arranged to spread the top film above the product to be packaged and to cut the top film to the specified dimensions. A press plate or equivalent as well is provided, which presses the product to be packaged from above, for the purpose of keeping the product to be packaged in position during the wrapping.

The present invention also concerns a method for the spreading of the top film in wrapping in a wrapping machine, by means of which the wrapping film is wound in the wrapping machine around the product to be packaged which has been brought into a wrapping station by means of a conveyor or equivalent. This film is unwound from a film roll fitted on a film distribution sledge, so that the film distribution sledge is rotated around a vertical central axis of the wrapping station. By means of a top film device provided in this wrapping machine, a top film is spread out above the product to be packaged and the top film is cut off to the specified dimensions. Furthermore, in the wrapping machine, the product to be packaged is kept in position during wrapping by means of a press plate or equivalent that presses the product from above.

In the prior art, a method is known for wrapping of products to be packaged by means of a wrapping film, in which the products to be packaged are brought into the wrapping machine by means of a conveyor which brings the product to be packaged, e.g., on a pallet into the wrapping machine and stops the product in the wrapping machine for the time of the wrapping. During the wrapping, the product to be packaged is kept immobile in the wrapping machine, and the wrapping film is wound around the product so that the roll of wrapping film is rotated around the product.

For the purpose of rotating the roll of wrapping film around the product, the roll is mounted on a film distribution sledge which is provided with suitable members so as to make the tension of the wrapping film appropriate during the wrapping. For the purpose of rotating the film distribution sledge around the product to be packaged, the wrapping machine may be provided with a wrapping crank which is arranged to be rotatable around a vertical central axis of the wrapping station. On the other hand, in such a machine the film distribution sledge is mounted on the wrapping crank to be vertically displaceable.

A second possibility for rotating the film distribution sledge around the product to be packaged, is such that the wrapping machine may be provided with a wrapping circle, circulating around the wrapping station, and on which the film distribution sledge is displaceably mounted. Thus, in such a machine, the film distribution sledge circulates around the product to be packaged in a circle. On the other hand, the wrapping circle is normally mounted on a frame of the wrapping machine to be vertically adjustable.

A significant problem in the prior art wrapping machines and methods, is the fitting of the top film or top sheet onto a product to be packaged, and the need of making the package sufficiently well-sealed. For the spreading of the top film, the wrapping machine is normally provided with a top film roll which is fitted on a stand placed on an upper part of the frame of the wrapping machine. From this stand, the top film is unwound by means of a top film pulling sledge, by means of which the film is pulled across the product to be packaged and thereupon cut off by means of a cutter to the desired length.

Especially in wrapping machines provided with a wrapping crank, the pulling of the top film has been questionable, because it has been necessary to stop the wrapping completely for the time of the pulling of the top film, since it has been necessary to fetch or grasp the top wrapping film by means of the pulling sledge from outside of the circumference of rotation of the wrapping crank. In such conventional wrapping machines, after the top film has been spread out above the product to be packaged and cut off to the desired dimension, the top film pulling sledge returns to its starting position, after which the wrapping has been continued so that the wrapping film to be wound around the product to be packaged binds the top film in its position. Thus, for example, in the case of pallet packages, the spreading of the top film has involved quite a considerable period of time during which the wrapping has been completely interrupted. The length of this time is normally in the order of 15 to 20 seconds.

It has been a further drawback related to the prior art methods and wrapping machines, even though of relatively minor importance, that, since the top film roll is placed outside the circle of rotation of the wrapping crank, the length of the top film unwound has always been considerably longer than would have been necessary in view of the package. Thus, in the prior art methods and machines, the consumption of the top film material has been considerably high.

SUMMARY OF THE INVENTION

Accordingly, it is an object of the present invention to eliminate the drawbacks related to the prior art methods and devices, as well as to increase the capacity of the wrapping machine by making the wrapping operation quicker.

These and other objects are attained by the present invention which is directed to a device for spreading a top wrapping film in a wrapping machine, which comprises first means for feeding the top film and second means for pulling the top film, the first and second means being arranged to move simultaneously in opposite directions from one another, whereby when one product having been wrapped is being replaced by a product to be wrapped, the second means pull out the top film from the first means. The first and second means are both movably mounted upon a frame of the machine, with the first means being arranged to pull out the film substantially to a middle of the wrapping station of the machine, and the second means arranged to pull the top film from substantially the middle of the wrapping station and across the wrapping station to a stand-by position, while wrapping is interrupted.

Additionally, the first means are arranged to move away from the second means as the second means pull the top film, while cutting means for cutting the top film to a specified dimension are also provided, along with a press plate for pressing the product to be wrapped to keep the same in position. The second means are arranged to pull the top film underneath the press plate.

The wrapping machine itself is additionally provided with a film distribution sledge for receiving a film or roll thereon and arranged to wind film from the roll thereon, around the product to be wrapped which has been brought to the wrapping station by a conveyor, with the film distribution sledge being rotatably mounted about a vertical center of the wrapping station. The first means are arranged to receive a top film roll.

The present invention is also directed to a method for spreading a top wrapping film in a wrapping machine, which comprises the steps of spreading out the top film in a stand-by position while a product having been wrapped is replaced by a product to be wrapped and wrapping is interrupted, maintaining the thus-spread-out film above the product to be wrapped (e.g. as the same as being wrapped), and then applying the top film to the product to be wrapped before the wrapping of the same has reached a predetermined stage. The top film is additionally cut to a specified dimension before being applied to the product to be wrapped.

The top film is applied by folding down edges of the same about the product to be wrapped, and continuing wrapping of the product, whereby the edges of the top film sheet are bound by the wrapping film being wrapped around the product. The top film is also spread out underneath a press plate for retaining the product to be wrapped in position, while the same is being wrapped.

The method also comprises the additional steps of bringing the product to be wrapped to a wrapping station by a conveyor, and wrapping film about the product at the station by unwinding the same from a roll fitted on a film distribution sledge rotated about a vertical central axis of the wrapping station.

In view of achieving the above-noted objects and others which will become apparent herein, the device in accordance with the present invention is principally characterized by devices for feeding and for pulling of the top film being arranged on a frame of a wrapping machine, to move at the same time in opposite directions with respect to one another, so that when products to be packaged are being exchanged and when the wrapping is interrupted, the feeding device is arranged to pull the top film out of the top-film roll substantially to the middle of the wrapping station, from where the pulling device is arranged to grasp or fetch the leading end of the top film and to pull the top film across the wrapping station, underneath a press plate, and to a stand-by position, while the feed device returns at the same time to its starting position and cuts off the top film to the specified dimension.

Accordingly, the present invention is directed to a device for the spreading of a top wrapping film in wrapping in a wrapping machine, the wrapping machine being provided with a film distribution sledge, a film roll fitted on the sledge from which the wrapping film is arranged to be wound in the wrapping machine around the product to be packaged which has been brought into the wrapping station by means of a conveyor or equivalent, the wrapping being carried out by rotating the film distribution sledge around a vertical center axis of the wrapping station. A top film device is provided which comprises a top film roll as well as devices for feeding and pulling the top film. These devices are arranged to spread the top film above the product to be packaged and to cut the top film to the specified dimension. The machine is also provided with a press plate or equivalent which presses the product to be packaged from above for the purpose of maintaining the product to be packaged in position during the wrapping.

More specifically, the devices for feeding and for pulling of the film are arranged on a frame of the wrapping machine to be movable at the same time in opposite directions as compared with one another, so that when the products to be packaged are being exchanged and when the wrapping is interrupted, the feed device is arranged to pull the top film out of the top film roll substantially to a middle of the wrapping station, from where the pulling device is arranged to grasp or fetch a leading end of the top film and to pull the top film across the wrapping station underneath a press plate to a stand-by position, while the feed device returns at the same time to its starting position and cuts off the top film to the specified dimension.

On the other hand, the method in accordance with the present invention is principally characterized by a top film being spread out to a stand-by position situated above a product to be packaged and underneath a press plate while the products to be packaged are being exchanged and the wrapping is interrupted, whereupon the wrapping of the product is begun and the top film sheet which has been cut to the specified dimension is maintained in spread out condition above the product to be packaged from where the edges of the top film sheet are folded downwardly against the sides of the product to be packaged after the wrapping has made progress to a desired stage, with the edges of the top film sheet then being bound by means of the wrapping film to be wrapped around the product.

In other words, the present invention is also directed to a method for the spreading of a top film in wrapping in a wrapping machine, by means of which the wrapping film is wound in the wrapping machine around a product to be packaged which has been brought into the wrapping station by means of a conveyor or equivalent, this film being unwound from a film roll fitted on a film distribution sledge so that the film distribution sledge is rotated around a vertical central axis of the wrapping station. By means of a top film device provided in the wrapping machine, the top film is spread out above the product to be packaged and the top film is cut off to the specified dimension. Furthermore, in the wrapping machine, the product to be packaged is maintained in its position during the wrapping by means of a press plate or equivalent that presses the product from above.

More specifically, in the invention method, the top film is spread out to a stand-by position situated above the product to be packaged and underneath the press plate, while the products to be packaged are being exchanged and the wrapping is interrupted, whereupon the wrapping of the product is begun and the top film sheet which has been cut to the specified dimensions is maintained as spread out above the product to be packaged, from where the edges of the top film sheet are folded downwardly against sides of the product to be packaged after the wrapping has made progress to the desired stage, with the edges of the top film sheet being bound by means of the wrapping film to be wrapped around the product.

It is a most remarkable advantage of the method and the device in accordance with the present invention, that by means of the invention herein, capacity of the wrapping machine can be substantially increased. This is due to the fact that in the invention herein, the top film is pulled to above the product to be packaged and cut to the specified dimension at a time when the wrapping is normally or otherwise at a standstill, i.e. when a ready-wrapped product is being removed out of the wrapping machine and a new product is being introduced into the machine for wrapping. In the method and the device of the present invention, the ready-cut top film is maintained in a stand-by position above the product to be packaged during the wrapping. When the wrapping has reached a suitable stage, the edges of the top film are turned downwardly.

Thus, in the method and the device of the present invention, the wrapping must be interrupted for only a short time during which the edges of the top film are folded downwardly. In practice, as compared with the prior art methods, this results in an acceleration of the wrapping per unit product to be packaged, by at least 15 seconds. Another advantage of the method and the device of the invention, is that the length of the top film can be better adapted to the desired dimensions, whereby in the method and the device of the present invention, the consumption of wrapping film is lower than in the prior-art solutions. The other advantages and characteristic features of the invention will become apparent from the following detail description of the present invention, and to which the present invention is, however, not intended to be solely restricted.

BRIEF DESCRIPTION OF THE DRAWINGS

The present invention will be described in greater detail below, with reference to exemplary embodiments illustrated in the accompanying figures, and to which, however, the present invention is not intended to be solely confined. In the drawings.

DESCRIPTION OF THE PREFERRED EMBODIMENTS

Figure 1:
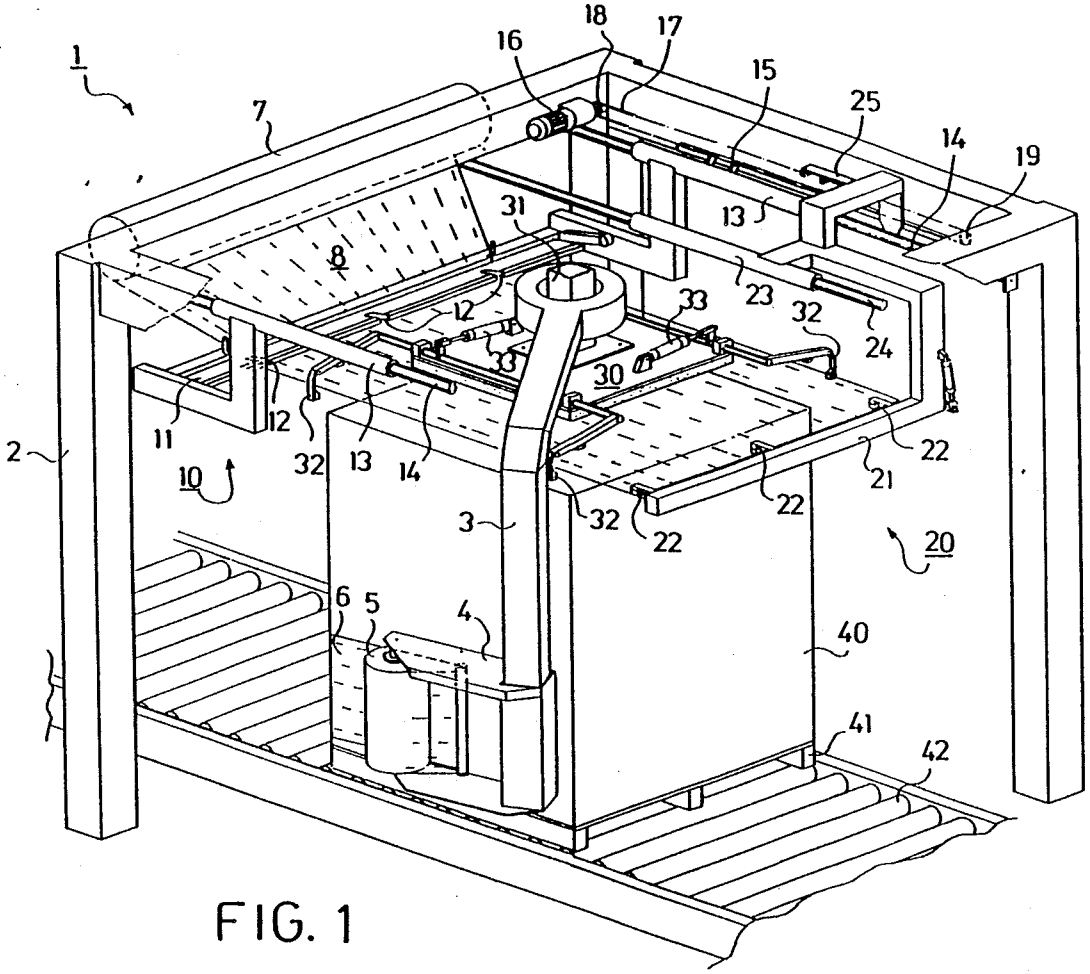
FIG. 1 is a perspective view of a wrapping machine, in which certain components not related to the present invention have been omitted so as to make the illustration clearer.

The wrapping machine is generally denoted by reference numeral 1 in FIG. 1. The wrapping machine 1 is of such a type as intended for the wrapping of products 40 to be packaged by means of wrapping film 6 so that the product 40 to be packaged is maintained stationary during the wrapping. The products 40 to be packaged are brought into the wrapping machine 1, and notably to the wrapping station thereof, by means of a conveyor 42.

In the exemplary embodiments illustrated in the figures, the product 40 to be packaged is situated on a pallet 41. The wrapping machine 1 illustrated in the figure is a so-called crank machine, which is provided with a wrapping crank 3 that is mounted on a frame 2 of the wrapping machine 1, so that the crank 3 revolves around a vertical center axis of the wrapping station. The wrapping crank 3 carried along with it, a film distribution sledge 4 on which a film roll 5 is mounted.

During wrapping, the wrapping crank 3 rotates the film distribution sledge 4 around the product 40 to be packaged while the wrapping film 6 is unwound from the film roll 5 fitted on the film distribution sledge 4. The film distribution sledge 4 is mounted on the wrapping crank 3 to be vertically displaceable so that, in the vertical direction, the entire product 40 to be packaged can be wrapped in the wrapping film 6.

Furthermore, the wrapping machine 1 includes a top film device which comprises a top film roll 7 mounted on a stand in an upper part of the frame 2 of the wrapping machine, as well as devices 10, 20 for feeding 10 and pulling 20 the top film 8, by means of which the top film 8 is unwound from the top-film roll 7 and onto the product 40 to be packaged. Furthermore, the wrapping machine 1 includes a press plate 30 which is attached to an arm 31. The arm 31 is mounted on the vertical central axis of the wrapping station to be vertically displaceable. During wrapping, the press plate 30 is arranged to be pressed against a top face of the product 40 to be packaged, so that the product 40 to be packaged remains stationary during the wrapping.

The top film feeder device 10 comprises grasping and cutting means 11 which extend across a width of the top film 8, and are in the shape of a beam, also being provided with slides 13. Correspondingly, the frame 2 of the wrapping machine is provided with guides 14, along which the slides 13 of the top-film feeder device 10 are arranged to move. The grasping and cutting means 11 included in the top-film feeder device 10 are arranged to grasp the top film 8 and to feed the film to a position above the product 40 to be packaged, as well as to cut the top film 8 to the specified dimension.

On the other hand, the top-film pulling device 20 includes a cross-beam 21 which extends transversely across the width of the top film 8 as illustrated. The cross-beam 21 is provided with grasping members 22 so as to grasp the top film 8 and, moreover, is provided with slides 23 corresponding to the slides described in conjunction with the top-film feeder device 10. The frame 2 of the wrapping machine is provided with guides 24 for the slides 23 of the top-film pulling device 20, along which the slides 23 are arranged to move. The slides 13 and 23 of the top film feeder device 10 and of the top film pulling device 20 are substantially parallel to one another, so that the feeder device 10 and the pulling device 20 can move in the same directions, even though they actually move opposite to one another at the same time.

For the sake of clarity in the illustrations, components belonging to the upper construction of the wrapping machine 1 have been eliminated in FIG. 1, so that only a guide 24 for the pulling device 20 situated at one side of the frame 2 is shown in FIG. 1. A corresponding guide is, however, also mounted on the other side of the wrapping machine 1. For moving the feeder device 10 and the pulling device 20 for the top film 8 along the respective guides 14 and 24, an actuator 16, e.g. an electric motor, is mounted on the frame 2 of the wrapping machine 1, for the feeder device and for the pulling device. The actuator 16 drives an endless chain 17 which passes over a drive wheel 18 rotated by the actuator 16 and over a guide wheel 19. Both the top-film feeder device 10 and the top-film pulling device 20 are attached to the chain 17 by means of attaching members 15 and 25. The feeder device 10 and the pulling device 20 are attached to the runs of the chain 17 that pass in opposite directions, so that when the chain 17 is operated by the actuator 16, the feeder 10 and the pulling device 20 move in opposite directions from one another.

As stated above, the wrapping machine 1 is provided with a press plate 30 by means of which a product 40 to be packaged is maintained stationary in the wrapping machine during wrapping. The press plate 30 is provided with holders 32 which are arranged to grasp the top film 8 while the top film is spread out between the product 40 to be packaged and the press plate 30. The holders 32 are pivoted, e.g., by means of pivoting devices 33 illustrated in FIG. 1.

Figure 3B:
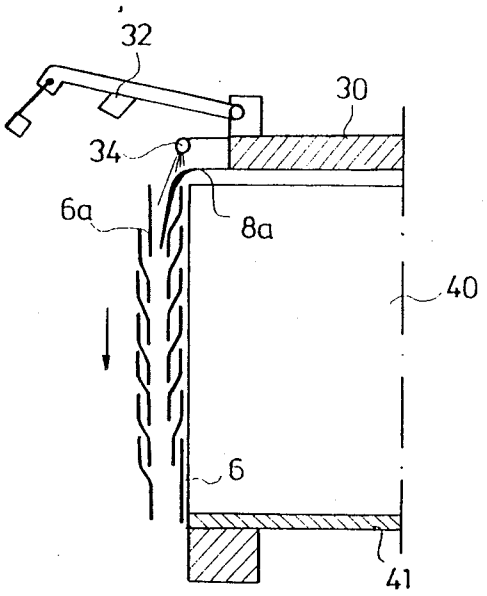
FIGS. 3A and 3B are schematic side views of the fitting of the top film onto a package and of the folding down of edges of the top film, in accordance with the invention herein.
Figure 3A:
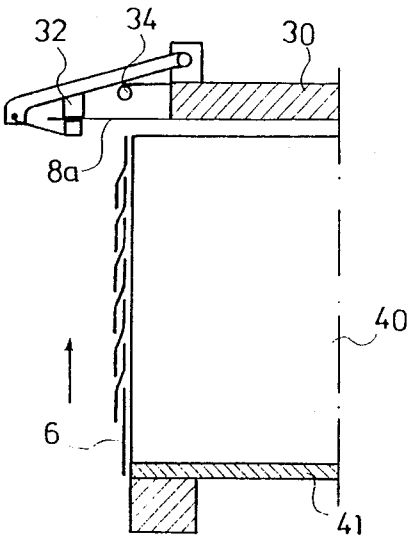

Moreover, the press plate 30 is provided with a top-film folding device 34 which is schematically illustrated in FIGS. 3A and 3B. The top-film folding device 34 has been omitted in the illustration of FIG. 1. This top-film folding device is, e.g., a pipe passing around a circumference of the press plate 30, with a number of holes being provided in a lower side thereof. Pressurized air is passed into the pipe so that air jets directed downwardly out of the holes formed into the pipe, fold the edges of the top film 8 downwardly as the top film is being fitted into position.

Figure 2A:
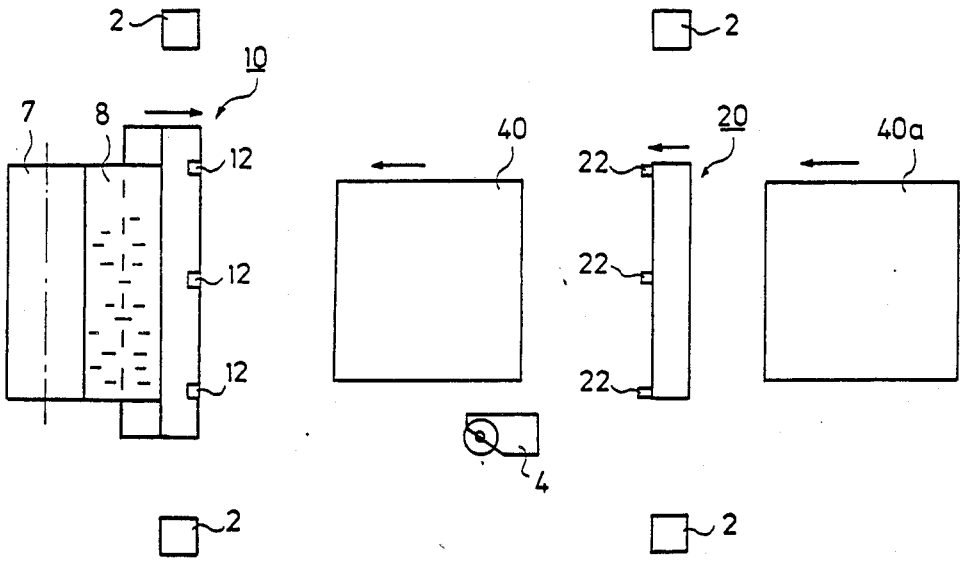
FIGS. 2A–2D are schematic top views of the spreading of a top film step by step in accordance with the present invention.

Different stages of the spreading of the top film will be described below, with reference to FIGS. 2A to 2D. In FIG. 2A, a situation is illustrated in which the product 40 placed in the wrapping station is fully wrapped with wrapping film and provided with the top film, so that the product 40 is ready for transfer further from the wrapping machine. Thus, in FIG. 2A, the wrapping has just been completed, and the film distribution sledge 4 has stopped at the side of the wrapping station. When the wrapping stops, the conveyor 42 starts transferring the product 40 out of the wrapping station, and starts bringing a new product **40*a*** into the wrapping station for wrapping.

At the same time as the wrapping stops, the actuator 16 of the feeder device 10 and of the folding device 20 is started, and begins shifting the feeder device 10 and the pulling device 20 towards one another and towards a middle of the wrapping station. At this stage, the press plate 30 has been raised so that the feeder 10 and the pulling 20 devices move underneath the level of the press plate 30 as the feeder device 10 pulls the top film 8 therealong.

Figure 2B:
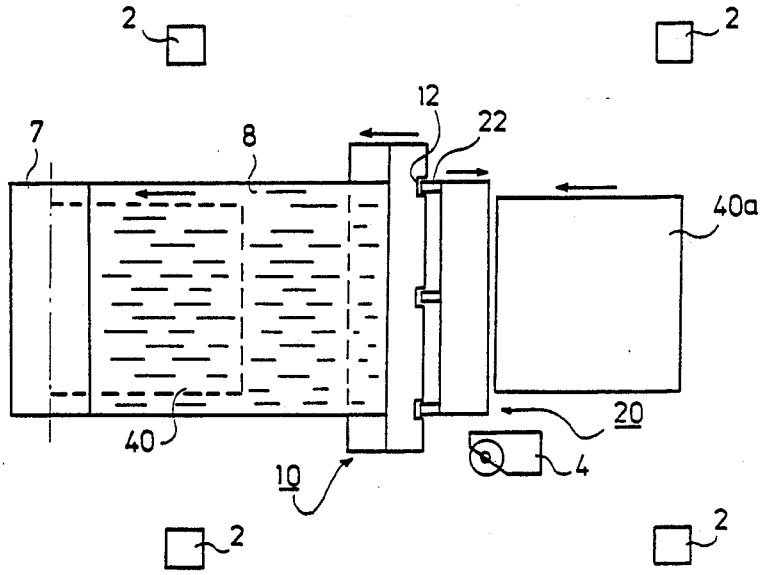

In the situation illustrated in FIG. 2B, the feeder device 10 and the pulling device 20 have moved to the middle of the wrapping station against one another. At this stage, the grasping members 22 provided on the top-film pulling device 20 grasp the top film at the same time as the top film feeder device 10 releases its grasp of the top film 8. Recesses 12 have been formed into the grasping and cutting means 11 of the feeder device 10, with the grasping members 22 of the pulling device 20 being fitted to pass into these recesses 12, so as to grasp the top film 8. After the grasping means 22 of the pulling device 20 have grasped the top film 8 and after the grasp of the feeder device 10 of the top film 8 has been released, the feeder device 10 and the pulling device 20 start immediately moving in opposite directions apart from one another, so that the pulling device 20 pulls the top film 8 along with it. For the time of the entire operation, the conveyor 42 transfers the packaged product away from the wrapping machine 1 and a new product **40*a*** to be packaged towards the wrapping station.

Figure 2C:
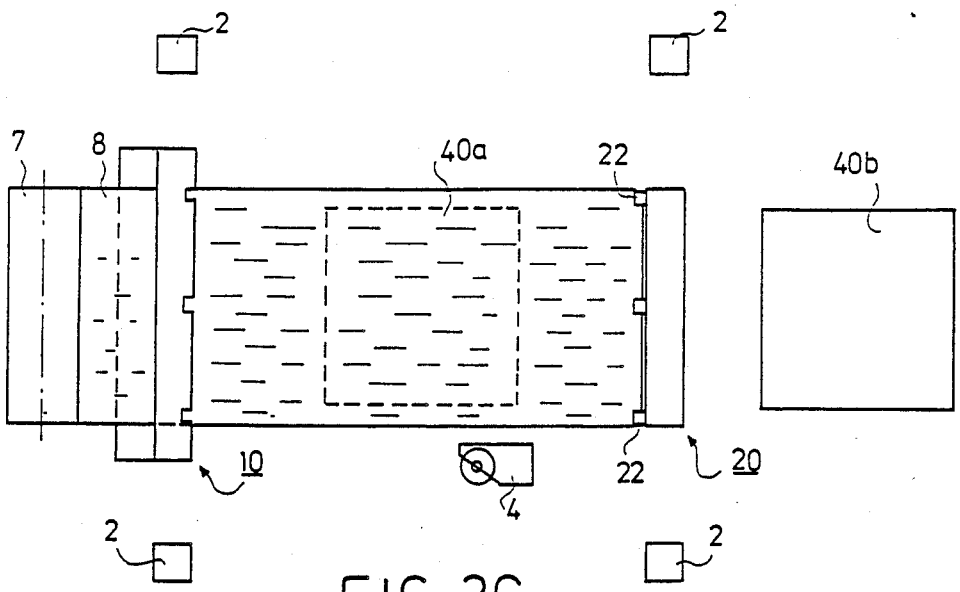
Figure 2D:
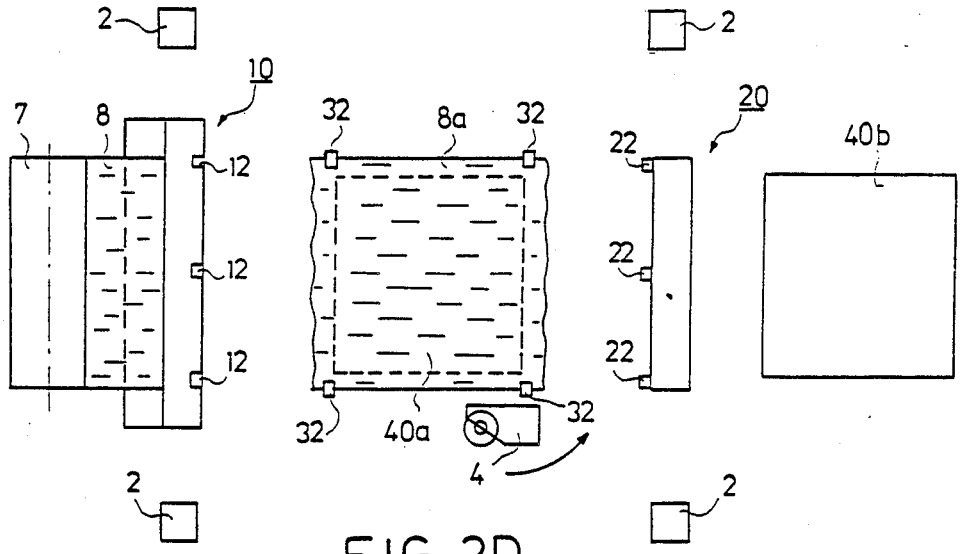

FIG. 2C illustrates a situation in which the feeder device 10 and the pulling device 20 have moved to their starting positions, so that the pulling device 20 has spread the top film 8 open above the wrapping station. In this situation, in accordance with FIGS. 2C and 2D, the holders 32 provided on the press plate 30 grasp the top film 8, and the grasping member provided on the feeder device 10 cuts off the top film 8 to make a sheet **8*a*. At the same time, the grasping members 22 provided on the pulling device 20 release their grasp of the top film 8. In this situation, the new product 40*a* to be packaged has completely moved into the wrapping station, and the next product 40*b* to be packaged has arrived in a waiting station outside the wrapping machine. After the sheet 8*a* has been fully placed on the holders 32, the press plate 30 is lowered against the product 40*a* to be packaged, and the film distribution sledge 4 starts moving so as to wrap the product 40*a* into the wrapping film 6**.

In order to make the package sufficiently well-sealed, the wrapping is begun in accordance with FIG. 3A from below, so as to wrap the wrapping film 6 as layers overlapping one another around the product 40. The press plate 30 is thereat placed against a top face of the product 40, while the sheet **8*a* made of the top film is between the press plate 30 and the top face of the product 40, being maintained in spread-out fashion by the holders 32. After the wrapping has reached the upper part of the product 40 to be packaged, the wrapping is interrupted for a short time, at which the holders 32 release their grasp of the sheet 8*a* and the top-film folding devices 34 fold the edges of the sheet 8*a* down against the side faces of the product 40** to be packaged, e.g. by means of air jets.

Hereupon, the wrapping is continued forthwith so that the wrapping film **6*a* to be wrapped around the product binds the top-film sheet 8*a* into its position, and the wrapping is advantageously continued down to the lower part of the product 40, so that a new layer of wrapping film 6*a* overlapping each other is formed onto the product 40. By means of this operation, a fully sealed packaging layer has been produced on the product 40**. After the operations in accordance with FIG. 3B have been carried out, the process moves back to the situation illustrated in FIG. 2A.

The present invention has been described above by way of example and with reference to the accompanying figures. This is, however, not intended to restrict the invention to just the exemplary embodiments illustrated in the figures alone. Rather, a number of variations are possible within the scope of the inventive concepts set forth herein. Therefore, the preceding description of the present invention is merely exemplary, and is not intended to limit the scope thereof in any way.

What is claimed is:

1. Method for spreading a top wrapping film in a wrapping machine, comprising the steps of spreading out the top film in a stand-by position while a product having been wrapped is replaced by a product to be wrapped and wrapping is interrupted, maintaining the thus spread-out film above the product to be wrapped, and then applying the top film to the product being wrapped before the wrapping of the same has reached a predetermined stage, wherein the spread out film is maintained above the product as the same is being wrapped.

2. Device for spreading a top wrapping film in a wrapping machine, said device comprising first means for feeding the top film and second means for pulling the top film, said first and second means being arranged to move simultaneously in opposite directions from one another, whereby when one product having been wrapped is being replaced by a product to be wrapped, said second means pull out the top film from said first means.

3. The device of claim 2, wherein said first and second means are both movably mounted upon a frame of the machine, said first means are arranged to pull out the film substantially to a middle of a wrapping station of the machine, and said second means are arranged to pull the top film from substantially the middle of the wrapping station and across the wrapping station to a stand-by position, while wrapping is interrupted.

4. The device of claim 3, wherein said first means are arranged to move away from said second means as said second means pull the top film, and additionally comprising means for cutting the top film to a specified dimension.

5. The device of claim 3, additionally comprising a press plate for pressing the product to be wrapped to keep the same in position, and wherein said second means are arranged to pull the top film underneath said press plate.

6. The device of claim 5, additionally comprising holders fitted at said stand-by position for retaining the thus-cut top film in spread-out position during wrapping of the product to be wrapped.

7. The device of claim 6, wherein said holders are pivotably mounted upon said press plate.

8. The device of claim 2, additionally comprising actuating means mounted upon the frame and fitted for shifting said first and second means under positive drive and simultaneously in opposite directions to one another.

9. The device of claim 8, wherein said actuating means comprise an endless chain passing around wheels, and a motor mounted on the frame and coupled to one of the wheels which is a drive wheel, with said first and second means attached to opposite runs of the chain so that when said chain moves said first and second means simultaneously move in the opposite directions from one another.

10. The device of claim 2, wherein the wrapping machine is additionally provided with a film distribution sledge for receiving a film roll thereon and arranged to wind film from the roll thereon around the product to be wrapped which has been brought to the wrapping station by a conveyor, said film distribution sledge being rotatably mounted about a vertical center of the wrapping station, and said first means arranged to receive a top film roll.

11. The device of claim 5, wherein the sledge is additionally mounted for movement in a vertical direction, whereby the entire product to be wrapped can be wrapped in wrapping film.

12. The device of claim 2, wherein said first means comprise slides mounted in guides in turn mounted upon the frame, and said second means comprise slides mounted in guides in turn mounted upon the frame, said guides of both said first and second means being substantially parallel with one another.

13. The device of claim 12, wherein said second means comprise a cross-beam coupled to said respective slides and provided with grasping members to grasp the top film, and said first means comprise a grasping and cutting beam coupled to said respective slides, extending across a width of the top film, and provided with recesses for receiving the grasping members of said second means.

14. The device of claim 7, additionally comprising folding means mounted upon said plate for folding the top film over the product to be wrapped, said folding means comprising a pipe mounted around a circumference of said plate and provided with a series of openings along a lower edge thereof, whereby pressurized air introduced into said pipe is directed downwardly out through said openings as air jets to fold edges of the top film downwardly about the product to be wrapped.

15. Method for spreading a top wrapping film in a wrapping machine, comprising the steps of spreading out the top film in a stand-by position while a product having been wrapped is replaced by a product to be wrapped and wrapping is interrupted, maintaining the thus spread-out film above the product to be wrapped, and then applying the top film to the product being wrapped before the wrapping of the same has reached a predetermined stage, wherein the top film is spread out into said stand-by position in two stages, a first stage in which the top film is pulled substantially to a middle of a wrapping station, and a second stage is which the top film is grasped and then pulled further across the wrapping station.

16. The method of claim 15, wherein in said first stage, the top film is pulled substantially to the middle of the wrapping station by a feeder device, and in said second stage, an end of the top film is grasped by a separate pulling device, with said pulling and feeding devices then being simultaneously displaced in opposite directions from one another.

17. The method of claim 16, wherein movement of said feeding and pulling devices are coupled to one another under positive drive.

* * * * *